US010184683B2

(12) United States Patent
Ohura et al.

(10) Patent No.: US 10,184,683 B2
(45) Date of Patent: Jan. 22, 2019

(54) AIR CONDITIONING DEVICE

(71) Applicant: DAIKIN INDUSTRIES, LTD., Osaka-shi, Osaka (JP)

(72) Inventors: Ryuuta Ohura, Osaka (JP); Yuusuke Oka, Osaka (JP); Junya Minami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/543,775

(22) PCT Filed: Dec. 17, 2015

(86) PCT No.: PCT/JP2015/006307
§ 371 (c)(1),
(2) Date: Jul. 14, 2017

(87) PCT Pub. No.: WO2016/120937
PCT Pub. Date: Aug. 4, 2016

(65) Prior Publication Data

US 2018/0003419 A1 Jan. 4, 2018

(30) Foreign Application Priority Data

Jan. 30, 2015 (JP) ..... 2015-017136

(51) Int. Cl.
*F24F 11/89* (2018.01)
*F25B 13/00* (2006.01)
(Continued)

(52) U.S. Cl.
CPC ..... *F24F 11/89* (2018.01); *F25B 13/00* (2013.01); *F25B 31/002* (2013.01);
(Continued)

(58) Field of Classification Search
CPC .. F25B 31/004; F25B 31/002; F25B 2500/16; F25B 2700/03; F25B 2700/1331;
(Continued)

(56) References Cited

U.S. PATENT DOCUMENTS

2004/0168446 A1* 9/2004 Taira ..... F25B 13/00 62/84
2010/0089082 A1* 4/2010 Kawano ..... F25B 31/004 62/192
(Continued)

FOREIGN PATENT DOCUMENTS

EP 2 256 435 A1 12/2010
JP 2001-208457 A 8/2001
(Continued)

*Primary Examiner* — Christopher R Zerphey
*Assistant Examiner* — Schyler S Sanks
(74) *Attorney, Agent, or Firm* — Birch, Stewart, Kolasch & Birch, LLP

(57) ABSTRACT

A multi-type air conditioning device controls an evaporation temperature and a condensing temperature, depending on required capacity of an indoor unit. The air conditioning device compares a current evaporation temperature or condensing temperature with a reference value, of an evaporation temperature or an condensing temperature, corresponding to a lower limit flow rate, of a gaseous refrigerant, required for refrigerating machine oil not to accumulate in, but to flow through, the gas branch pipes, and calculates an amount of the refrigerating machine oil accumulated in a gas branch pipe which does not satisfy the lower limit flow rate. When the calculated amount exceeds a set amount, the air conditioning device performs oil collecting operation, and controls the oil collecting operation in view of a flow rate of a gaseous refrigerant in gas branch pipes.

8 Claims, 3 Drawing Sheets

(51) Int. Cl.
*F25B 31/00* (2006.01)
*F25B 49/02* (2006.01)

(52) U.S. Cl.
CPC ..... *F25B 31/004* (2013.01); *F25B 49/02* (2013.01); *F25B 49/022* (2013.01); *F25B 2313/006* (2013.01); *F25B 2313/0233* (2013.01); *F25B 2313/02741* (2013.01); *F25B 2313/0314* (2013.01); *F25B 2313/0315* (2013.01); *F25B 2500/16* (2013.01); *F25B 2500/19* (2013.01); *F25B 2600/19* (2013.01); *F25B 2600/21* (2013.01); *F25B 2700/03* (2013.01); *F25B 2700/21151* (2013.01); *F25B 2700/21152* (2013.01)

(58) Field of Classification Search
CPC .... F25B 2700/1353; F25B 2700/21175; F25B 2700/21163
USPC ..... 62/84, 192, 193, 468
See application file for complete search history.

(56) References Cited

U.S. PATENT DOCUMENTS

2012/0285188 A1* 11/2012 Honda ..... F25B 7/00 62/160
2013/0000339 A1* 1/2013 Shimazu ..... F25B 31/004 62/192
2013/0067944 A1* 3/2013 Kibo ..... F25B 49/02 62/157
2015/0135749 A1* 5/2015 Ohta ..... F16K 11/048 62/151

FOREIGN PATENT DOCUMENTS

JP 2008-180421 A 8/2008
JP 2008-209105 A 9/2008
JP 2011-257126 A 12/2011
JP 2012-122638 A 6/2012
JP 2012122638 A * 6/2012

* cited by examiner

FIG. 3

| INDOOR UNIT CAPACITY | | Q1 | Q2 | Q3 | Q4 |
|---|---|---|---|---|---|
| INDOOR FAN TAP | H | 15 | 15 | 15 | 15 |
| | M | 13 | 14 | 14 | 15 |
| | L | 11 | 12 | 13 | 14 |

FIG. 4

| INDOOR UNIT CAPACITY | | Q1 | Q2 | Q3 | Q4 |
|---|---|---|---|---|---|
| INDOOR FAN TAP | H | 29 | 29 | 29 | 29 |
| | M | 37 | 35 | 33 | 31 |
| | L | 42 | 41 | 36 | 32 |

AIR CONDITIONING DEVICE

TECHNICAL FIELD

The present invention relates to air conditioning devices to which an outdoor unit and indoor units are connected, and, in particular, to control of oil collecting operation for an air conditioning device determining a target value of an evaporation temperature or a condensing temperature of a refrigerant circuit, depending on air-conditioning load in a room, and based on the target value, controlling operational capacity of a compressor.

BACKGROUND ART

Typically, a known multi-type air conditioning device installed in a building including multiple rooms has a refrigerant circuit to which an outdoor unit and multiple indoor units are connected with an interconnecting pipe for providing a vapor compression refrigeration cycle. (See, for example, PATENT DOCUMENT1.) In the multi-type air conditioning device, the interconnecting pipe includes: a liquid main pipe connected to the outdoor unit, and liquid branch pipes branching off from the liquid main pipe and each connected to a corresponding one of the indoor units; and a gas main pipe connected to the outdoor unit, and gas branch pipes branching off from the gas main pipe and each connected to a corresponding one of the indoor units.

Moreover, the air conditioning device cited in PATENT DOCUMENT1 saves energy by obtaining required capacity of an indoor unit and controlling operational capacity of the compressor and a volume of air from an indoor fan, so that a refrigerant temperature (an evaporation temperature or a condensing temperature) of an indoor heat exchanger is brought to a target temperature, depending on the required capacity. Specifically, the air conditioning device cited in PATENT DOCUMENT1 controls, for example, the operational capacity of the compressor so that a refrigeration cycle is provided at the target evaporation temperature and the target condensing temperature, while changing in the energy-saving operation the target evaporation temperature and the target condensing temperature for every predetermined time period depending on the required capacity of the indoor unit.

When a compressor of the refrigerant circuit is activated in the air conditioning device, portion of refrigerating machine oil, stored in the compressor for lubricating a compression mechanism and a bearing in the compressor, flows out of the compressor together with a refrigerant and circulates in the refrigerant circuit. Here, in liquefied portion of the refrigerant in the refrigerant circuit, the refrigerating machine oil flows in the circuit together with the refrigerant; however, in gaseous portion of the refrigerant, portion of the refrigerating machine oil adheres to interior surfaces of a heat exchanger tube of a heat exchanger and a refrigerant pipe. Furthermore, when a flow rate of the gaseous refrigerant is high, the refrigerating machine oil that adhered to the interior surfaces of the heat exchanger tube and the refrigerant pipe is pushed by the gaseous refrigerant, flows inside the refrigerant circuit, and returns to the compressor. When the flow rate of the gaseous refrigerant is low, however, the refrigerating machine oil stays adhered to the interior surfaces of the heat exchanger tube and the refrigerant pipe, and fails to return to the compressor. Thus, this kind of air conditioning device typically performs oil collecting operation which involves increasing the flow rate of the gaseous refrigerant with every time period set on a timer, and collecting the refrigerating machine oil into the compressor.

CITATION LIST

Patent Document

PATENT DOCUMENT 1: Japanese Unexamined Patent Publication No. 2011-257126

SUMMARY OF THE INVENTION

Technical Problem

In the air conditioning device providing control to bring a refrigerant temperature (an evaporation temperature or a condensing temperature) of an indoor heat exchanger to a target temperature depending on the required capacity, when the target evaporation temperature rises in the cooling operation and the target condensing temperature falls in the heating operation for saving energy, an amount of the refrigerant circulating in the refrigerant circuit decreases. Thus, in the air conditioning device to which indoor units having a different capacity are connected, the refrigerant flow rate of the gas branch pipes connected to an indoor unit becomes low, depending on the indoor unit. Specifically, in the energy-saving operation, a certain branch pipe of the interconnecting pipe might have a flow rate of the refrigerant smaller than a lower limit of a flow rate required for oil collection even though the main pipe of the interconnecting pipe has a flow rate of the refrigerant exceeding the lower limit of the flow rate required for the oil collection.

When a flow rate of the refrigerant in the gas branch pipes is low, the refrigerating machine oil stays adhered to the interior surfaces of the heat exchanger tube and the refrigerant pipe, and fails to return to the compressor as stated above. Then, the amount of the refrigerant accumulated in the gas branch pipes increases, and the amount of the refrigerating machine oil stored in the compressor decreases. As a result, the compressor is run while the stored amount of the refrigerating machine oil is small, which is likely to cause the compressor to develop a lubrication-related malfunction.

As described above, in a typical multi-type air conditioning device controlling operation of the refrigerant circuit so that the refrigerant temperature of an indoor heat exchanger is brought to the target temperature depending on the required capacity of the indoor unit, the flow rate of the refrigerant in a gas branch pipe can be lower than a necessary flow rate for collecting oil. Such a typical multi-type air conditioning device does not collect the refrigerating machine oil in view of the flow rates of the gaseous refrigerant in the gas branch pipes.

The present invention is conceived in view of the above problems. In a multi-type air conditioning device which controls operation of the refrigerant circuit so that a refrigerant temperature of an indoor heat exchanger is brought to a target temperature depending on required capacity of an indoor unit, the present invention attempts to control oil collecting operation in view of a flow rate of a gaseous refrigerant in gas branch pipes in order to reduce the risk of a lubrication-related malfunction in a compressor.

Solution to the Problem

In a first aspect of the present disclosure, an air conditioning device includes: a refrigerant circuit (11) including an outdoor unit (20) and indoor units (40) connected to each other via an interconnecting pipe (71,72); and an operation controller (80) controlling operation of the refrigerant circuit (11), the interconnecting pipe (71,72) including: a liquid main pipe (71*a*) connected to the outdoor unit (20), and liquid branch pipes (71*b*) branching off from the liquid main pipe (71*a*) and each connected to a corresponding one of the indoor units (40); and a gas main pipe (72*a*) connected to the outdoor unit (20), and gas branch pipes (72*b*) branching off from the gas main pipe (72*a*) and each connected to a corresponding one of the indoor units (40), and the controller (80) including an air-conditioning capacity controller (37*a*, 47*a*, 47*b*) determining a target value of an evaporation temperature or a condensing temperature of the refrigerant circuit (11), depending on air-conditioning load in a room, and, based on the target value (the target evaporation temperature or the target condensing temperature), controlling operational capacity of the compressor (21) in the refrigerant circuit (11).

In this air conditioning device, the operation controller (80) includes an oil collection controller (81) calculating an amount of refrigerating machine oil accumulated in the interconnecting pipe (71,72) during the operation, and when the calculated amount exceeds a preset amount, performing oil collecting operation for collecting the refrigerating machine oil in the refrigerant circuit (11) into the compressor (21), and the oil collection controller (81) includes an oil accumulation amount calculator (82): comparing (i) a current value of the target evaporation temperature or the target condensing temperature of the refrigerant circuit (11) with (ii) a set value of the evaporation temperature or the condensing temperature; determining, when the gas branch pipes (72*b*) are determined to include a gas branch pipe (72*b*) which does not satisfy the lower limit flow rate, that the refrigerating machine oil accumulates in the gas branch pipe (72*b*); and calculating an amount of the refrigerating machine oil accumulated in the gas branch pipe (72*b*), the set value being a reference value determined, for each of the indoor units (40), to correspond to a lower limit flow rate, of a gaseous refrigerant, necessary for the refrigerating machine oil to flow together with the refrigerant, and not to accumulate, in the gas branch pipes (72*b*). In the above features, a current value of the target evaporation temperature or a current value of the target condensing temperature may be used as "the current value of the evaporation temperature or the condensing temperature" to be compared with the reference value. Instead, an actual current value of the evaporation temperature or the condensing temperature may also be used.

Note that in the first aspect of the present disclosure, the term "target value" is a target evaporation temperature and a target condensing temperature in performing control depending on air-conditioning load in a room. The term "reference value" is a value referenced for determining whether the flow rate of the refrigerant in the gas branch pipes is high or low. The term "set value" is a value of an evaporation temperature and a condensing temperature to be used as the reference value. The term "set amount" is a value for determining whether the oil collection is necessary because of the refrigerating machine oil accumulated in a refrigerant pipe. The above terms are to be used in the above meanings throughout this Description.

This first aspect involves determining the target value of the evaporation temperature or the condensing temperature of the refrigerant circuit (11), depending on the air-conditioning load in a room. When the energy-saving operation is performed based on the target value to control the operational capacity of the compressor (21) in the refrigerant circuit, the current value of the evaporation temperature or the condensing temperature of the refrigerant circuit (11) is compared with the reference value, of the evaporation temperature or the condensing temperature determined, determined for each of the indoor units (40), to correspond to the lower limit flow rate, of the gaseous refrigerant, necessary for the refrigerating machine oil to flow together with the refrigerant, and not to accumulate, in the gas branch pipes (72*b*). When the gas branch pipes (72*b*) are determined to include a gas branch pipe (72*b*) which does not satisfy the lower limit flow rate, the first aspect involves determining that the refrigerating machine oil accumulates in the gas branch pipe (72*b*) and calculating the amount of the refrigerating machine oil accumulated in the gas branch pipe (72*b*). Then, when the calculated value exceeds a preset amount, the oil collecting operation is performed and the refrigerating machine oil in the refrigerant circuit (11) is collected in the compressor (21).

In the second aspect of the present disclosure according to the first aspect, the oil collection controller (81) includes a reference value storage (83) having the reference value, of the lower limit flow rate for the gas branch pipes (72*b*), for one or more air volume levels to be set for each indoor unit (40), and, the oil accumulation amount calculator (82) compares, for each indoor unit (40), the reference value for the one or more air volume levels with a current value of the evaporation temperature or the condensing temperature of the refrigerant in the gas branch pipes (72*b*), determines whether the gas branch pipes (72*b*) include a gas branch pipe (72*b*) in which a flow rate of the gaseous refrigerant is lower than the lower limit flow rate, and calculates the amount of the accumulated refrigerating machine oil.

This second aspect involves comparing (i) the current value of the evaporation temperature or the condensing temperature of the refrigerant in a gas branch pipe (72*b*) with (ii) the reference value, of the lower limit flow rate of the gaseous refrigerant, for the one or more air volume levels to be set on an indoor unit (40) to which the gas branch pipe (72*b*) is connected, and determining whether the refrigerating machine oil is accumulated in the gas branch pipe (72*b*). Based on the result of the determination, the embodiment involves calculating the amount of the refrigerating machine oil accumulated in the gas branch pipe (72*b*), and, when the accumulated amount exceeds a set amount, the embodiment involves performing the oil collecting operation.

In a third aspect of the present disclosure according to the first aspect or the second aspect, in cooling operation, the oil accumulation amount calculator (82) determines whether the gas branch pipes (72*b*) includes a gas branch pipe (72*b*) in which the current value of the evaporation temperature is higher than the set value, and calculates the accumulated amount of refrigerating machine oil, and the oil collection controller (81) performs the oil collecting operation, staying in a cooling cycle.

This third aspect involves determining, in cooling operation, whether the gas branch pipes (72*b*) include a gas branch pipe (72*b*) in which the current value of the evaporation temperature is higher than the set value, and calculates the accumulated amount of refrigerating machine oil. When the accumulated amount exceeds the set amount, the third aspect involves performing the oil collecting operation, staying in a cooling cycle. When the oil collecting operation is performed, the flow rate of the refrigerant is raised so that the refrigerating machine oil in the gas branch pipes (72*b*) flows through the gas main pipe (72*a*) toward the outdoor unit (20), and is collected in the compressor (21).

In a fourth aspect of the present disclosure according to the first aspect or the second aspect, in heating operation, the oil accumulation amount calculator (82) determines whether the gas branch pipes (72*b*) includes a gas branch pipe (72*b*) in which the current value of the condensing temperature is lower than the set value, and calculates the accumulated amount of refrigerating machine oil, and the oil collection controller (81) performs the oil collecting operation, with the heating operation switching to a cooling cycle.

This fourth aspect involves determining, in the heating operation, whether the gas branch pipes (72*b*) include a gas branch pipe (72*b*) in which the current value of the condensing temperature is lower than the set value, and calculating the accumulated amount of the refrigerating machine oil. When the accumulated amount exceeds the set amount, the fourth aspect involves performing the oil collecting operation, with the heating operation switching to the cooling cycle. When the oil collecting operation is performed, with the heating operation switching to the cooling cycle, the flow rate of the refrigerant is raised so that the refrigerating machine oil in the gas branch pipes (72*b*) flows through the gas main pipe (72*a*) toward the outdoor unit (20), and is collected in the compressor (21).

In a fifth aspect of the present disclosure according to the first aspect or the second aspect, in heating operation, the oil accumulation amount calculator (82) determines whether the gas branch pipes (72*b*) includes a gas branch pipe (72*b*) in which the current value of the condensing temperature is lower than the set value, and calculates the accumulated amount of refrigerating machine oil, and the oil collection controller (81) performs the oil collecting operation, staying in a heating cycle.

This fifth aspect involves determining, in heating operation, whether the gas branch pipes (72*b*) include a gas branch pipe (72*b*) in which the current value of the condensing temperature is lower than the set value, and calculating the accumulated amount of refrigerating machine oil. When the accumulated amount exceeds the set amount, the third aspect involves performing the oil collecting operation, staying in a heating cycle. When the oil collecting operation is performed, staying in the heating cycle, the flow rate of the refrigerant is raised so that the refrigerating machine oil in the gas branch pipes (72*b*) flows from the indoor units (40) through the liquid main pipe (71*a*), and is collected in the compressor (21) from an opposite direction in the cooling cycle.

Advantages of the Invention

In energy-saving operation, the first aspect of the present disclosure makes it possible to control the oil collecting operation, in view of a flow rate of the gaseous refrigerant in the gas branch pipes (72*b*), reducing the risk of a lubrication-related malfunction caused by oil shortage in the compressor (21).

Furthermore, the second aspect of the present disclosure involves comparing (i) a current value of a target evaporation temperature or a target condensing temperature of a refrigerant in a gas branch pipe (72*b*) with (ii) the reference value, of the lower limit flow rate of the gaseous refrigerant, for one or more air volume levels to be set on an indoor unit (40) to which the gas branch pipe (72*b*) is connected, and determining whether the refrigerating machine oil is accumulated in the gas branch pipe (72*b*). Based on the result of the determination, the second aspect involves calculating the accumulated amount of the refrigerating machine oil, and, when the accumulated amount exceeds a set amount, performing the oil collecting operation. Such features make it possible to enhance control precision of the oil collecting operation in view of the flow rate of the gaseous refrigerant in the gas branch pipes (72*b*), reducing the risk of lubrication-related malfunction in the compressor (21). The accurate determination is implemented because of the following reasons: If the indoor units (40) are the same in capacity, the evaporation temperature and the condensing temperature, determined by the lower limit flow rate in return of oil, respectively rises as the air volume level increases and falls as the air volume level increases. Thus, when the reference value is determined based on the air volume level and compared with a current value, accuracy of the determination is higher than when an average reference value is determined for each indoor unit (40) regardless of air volume levels and compared with a current value.

The third aspect of the present disclosure involves determining whether the gas branch pipes (72*b*) include a gas branch pipe (72*b*) in which a current value of the evaporation temperature is higher than the set value, and calculating the accumulated amount of the refrigerating machine oil. When the accumulated amount exceeds the set amount, the embodiment involves performing the oil collecting operation, staying in the cooling cycle. Such features make it possible to collect the refrigerating machine oil accumulated in the gas branch pipe (71*b*) into the compressor (21).

In the heating operation, the fourth aspect of the present disclosure involves determining whether the gas branch pipes (72*b*) include a gas branch pipe (72*b*) in which a current value of the target condensing temperature is lower than the set value, and calculating the accumulated amount of the refrigerating machine oil. When the accumulated amount exceeds the set amount, the embodiment involves performing the oil collecting operation, with the heating operation switching to the cooling cycle. Such features make it possible to collect the refrigerating machine oil accumulated in the gas branch pipe (71*b*) into the compressor (21).

In the heating operation, the fifth aspect of the present disclosure involves determining whether the gas branch pipes (72*b*) include a gas branch pipe (72*b*) in which a current value of the condensing temperature is lower than the set value, and calculating the accumulated amount of the refrigerating machine oil. When the accumulated amount exceeds the set amount, the embodiment involves performing the oil collecting operation, staying in the heating cycle. Similar to the fourth aspect of the present disclosure, such features make it possible to collect the refrigerating machine oil accumulated in the gas branch pipe (71*b*) into the compressor (21).

BRIEF DESCRIPTION OF THE DRAWINGS

FIG. 3 is a table showing an example of a reference value (an evaporation temperature for each indoor unit) for calculating an amount of oil accumulated in a gas interconnecting pipe in cooling operation.

FIG. 4 is a table showing an example of a reference value (a condensing temperature for each indoor unit) for calculating an amount of oil accumulated in a gas interconnecting pipe in heating operation.

DETAILED DESCRIPTION

Embodiments of the present disclosure will now be described in detail with reference to the drawings.

<Configuration of Air Conditioning Device>

Figure 1:
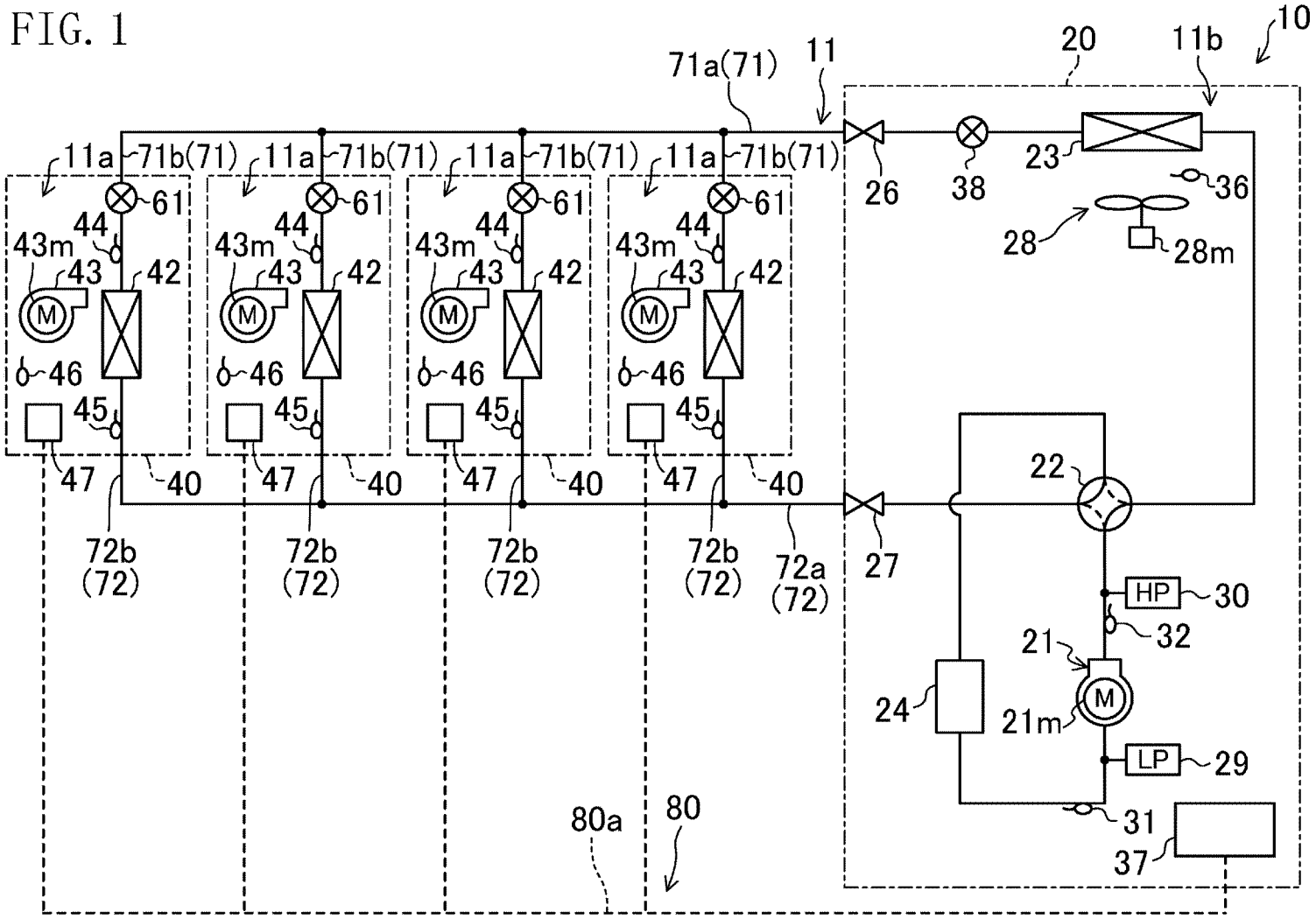
FIG. 1 is a diagram illustrating a refrigerant circuit of an air conditioning device according to this embodiment.

FIG. 1 illustrates a refrigerant circuit of an air conditioning device (10) according to this embodiment. An air conditioning device (10) heats and cools rooms in a building by performing a vapor compression refrigeration cycle operation. The air conditioning device (10) mainly includes: an outdoor unit (20) acting as one heat source unit; multiple indoor units (40) (four units in this embodiment) connected in parallel with the outdoor unit (20), and acting as utilization units (used for changing a room temperature); and a liquid interconnecting pipe (71) and a gas interconnecting pipe (72) acting as an interconnecting pipe (71, 72) connecting the outdoor unit (20) with the indoor units (40). Specifically, the refrigerant circuit (11) of a vapor compression type in the air conditioning device (10) according to this embodiment includes the outdoor unit (20) and the indoor units (40) connected to each other via the liquid interconnecting pipe (71) and the gas interconnecting pipe (72).

The interconnecting pipe (71, 72) includes: a liquid main pipe (71*a*) connected to the outdoor unit (20); and liquid branch pipes (71*b*) branching off from the liquid main pipe (71*a*) and each connected to a corresponding one of the indoor units (40). The gas interconnecting pipe (72) includes: a gas main pipe (72*a*) connected to the outdoor unit (20); and gas branch pipes (72*b*) branching off from the gas main pipe (72*a*) and each connected to a corresponding one of the indoor units (40).

<Indoor Unit>

Each of the indoor units (40) is flush-mounted to or suspended from a ceiling of, for example, a building. Alternatively, the indoor unit (40) is mounted on an indoor wall surface. The indoor units (40) are connected to the outdoor unit (20) via the liquid interconnecting pipe (71) and the gas interconnecting pipe (72), and constitute a part of the refrigerant circuit (11).

The indoor unit (40) includes an indoor refrigerant circuit (11*a*) which constitutes a part of the refrigerant circuit (11). This indoor refrigerant circuit (11*a*) includes: an indoor expansion valve (41) acting as an expansion mechanism; and an indoor heat exchanger (42) acting as a user-side heat exchanger. Note that in this embodiment, the indoor expansion valve (41) as an expansion mechanism is provided to, but not limited to, each indoor unit (40). Alternatively, the expansion mechanism may be provided to the outdoor unit (20), and also to a connection unit separated from the indoor unit (40) and the outdoor unit (20).

The indoor expansion valve (41) is an electric expansion valve connected to a liquid side of the indoor heat exchanger (42) for, for example, adjusting a flow rate of a refrigerant flowing in the indoor refrigerant circuit (11*a*). The indoor expansion valve (41) may also block the passing refrigerant.

The indoor heat exchanger (42) is a cross-fin fin-and-tube heat exchanger including a heat exchanger tube and many fins. In the cooling operation, the indoor heat exchanger (42) functions as an evaporator for the refrigerant to cool indoor air. In the heating operation, the indoor heat exchanger (42) functions as a condenser for the refrigerant to heat the indoor air. Note that, in this embodiment, the indoor heat exchanger (42) is, but not limited to, a cross-fin fin-and-tube heat exchanger. Alternatively, the indoor heat exchanger (42) may be any other type of heat exchanger.

The indoor unit (40) includes an indoor fan (43) acting as an air blower for sucking indoor air into the unit, causing the indoor heat exchanger (42) to exchange heat between the sucked air and the refrigerant, and then supplying the air as supply air. The indoor fan (43) is capable of adjusting a volume of air to be supplied to the indoor heat exchanger (42) within a range of a predetermined air volume. In this embodiment, examples of the indoor fan (43) include a centrifugal fan and a multi-blade fan driven by a motor (43*m*) such as a DC fan motor.

In this embodiment, the indoor fan (43) may operate in an air volume setting mode set with such an input device as a remote control. The air volume setting mode includes: an air volume holding mode setting the volume of air in three kinds of held air volume; namely, low wind supplying the smallest volume of air, high wind supplying the largest volume of air, and middle wind approximately midway between the low wind and the high wind; and an auto air volume mode automatically changing the volume of air between the low wind and the high wind, depending on, for example, a degree of superheat SH and a degree of subcooling SC. Specifically, when a user selects, for example, any one of "low wind", "middle wind", and "high wind", the indoor fan (43) operates in the air volume holding mode holding the volume of air in the low wind. When the user selects "auto", the indoor fan (43) operates in the auto air volume mode automatically changing the volume of air depending on an operating state. Note that in this embodiment, a fan tap of the indoor fan (43) for the volume of air may be switched between, but not limited to, three stages such as "low wind (L)", "middle wind (M)", and "high wind (H)". Alternatively, the tap may be switched between, for example, ten stages.

Moreover, the indoor unit (40) is provided with various kinds of sensors. The liquid side of the indoor heat exchanger (42) is provided with a liquid temperature sensor (44) detecting a temperature of the refrigerant (a refrigerant temperature corresponding to a condensing temperature Tc in the heating operation or an evaporation temperature Te in the cooling operation). A gas side of the indoor heat exchanger (42) is provided with a gas temperature sensor (45) detecting a temperature of the refrigerant. An indoor air inlet side of the indoor unit (40) is provided with an indoor temperature sensor (46) detecting a temperature of the indoor air (an indoor temperature Tr) flowing into the unit. In this embodiment, thermistors are used as the liquid temperature sensor (44), the gas temperature sensor (45), and the indoor temperature sensor (46).

Moreover, the indoor unit (40) includes an indoor controller (47) controlling operations of the devices included in the indoor unit (40). The indoor controller (47) includes: an air-conditioning capacity calculator (47*a*) calculating, for example, current air-conditioning capacity of the indoor unit (40); and a requested temperature calculator (47*b*) calculating a requested evaporation temperature Ter or a requested condensing temperature Tcr required for the indoor unit (40) to achieve its capacity based on its current air-conditioning capacity. Then, the indoor controller (47) includes a microcomputer and a memory (47*c*) provided to control the indoor unit (40). The indoor controller (47) may exchange, for example, a control signal with a remote controller (not shown) for individually operating each of the indoor units (40), and with the outdoor unit (20) via a transmission pipe (80*a*).

<Outdoor Unit>

Provided out of the building, the outdoor unit (20) is connected to the indoor units (40) via the liquid interconnecting pipe (71) and the gas interconnecting pipe (72). Together with the indoor units (40), the outdoor unit (20) constitutes the refrigerant circuit (11).

The outdoor unit (20) includes an outdoor refrigerant circuit (11*b*) which constitutes a part of the refrigerant circuit (11). This outdoor refrigerant circuit (11*b*) includes:

a compressor (21); a four-way switching valve (22); an outdoor heat exchanger (23) acting as a heat-source-side heat exchanger; an outdoor expansion valve (38) acting as an expansion mechanism; an accumulator (24); a liquid stop valve (26); and a gas stop valve (27).

The compressor (21) is capable of adjusting its operational capacity. In this embodiment, the compressor (21) is a positive displacement compressor driven by a motor (21*m*) a rotation speed of which is controlled by an inverter. Note that the compressor (21) illustrated in this embodiment is, but not limited to, the only compressor. Alternatively, two or more compressors may be connected in parallel, depending on, for example, the number of indoor units connected to the outdoor units.

The four-way switching valve (22) is for switching a flow direction of the refrigerant. In the cooling operation, in order to cause the outdoor heat exchanger (23) to function as a condenser for the refrigerant to be compressed by the compressor (21) and to cause the indoor heat exchangers (42) to function as an evaporator for the refrigerant to be condensed in the outdoor heat exchanger (23), the four-way switching valve (22) connects (i) a discharge side of the compressor (21) with a gas side of the outdoor heat exchanger (23), and (ii) a suction side of the compressor (21) (specifically, the accumulator (24)) with the gas interconnecting pipe (72). (A cooling operation state: see solid pipes of the four-way switching valve (22) in FIG. 1.) In the heating operation, in order to cause the indoor heat exchangers (42) to function as a condenser for the refrigerant to be compressed by the compressor (21) and to cause the outdoor heat exchanger (23) to function as an evaporator for the refrigerant to be condensed in the indoor heat exchanger (42), the four-way switching valve (22) connects (i) the discharge side of the compressor (21) with the gas interconnecting pipe (72), and (ii) the suction side of the compressor (21) with the gas side of the outdoor heat exchanger (23). (A heating operation state: see broken pipes of the four-way switching valve (22) in FIG. 1.)

The outdoor heat exchanger (23) is a cross-fin fin-and-tube heat exchanger for exchanging heat between air as a heat source and the refrigerant. The outdoor heat exchanger (23) functions as a condenser for the refrigerant in the cooling operation, and as an evaporator for the refrigerant in the heating operation. The outdoor heat exchanger (23) has the gas side connected to the four-way switching valve (22) and the liquid side connected to the outdoor expansion valve (38). Note that, in this embodiment, the outdoor heat exchanger (23) is, but not limited to, a cross-fin fin-and-tube heat exchanger. Alternatively, the outdoor heat exchanger (23) may be any other type of heat exchanger.

The outdoor expansion valve (38) is an electronic expansion valve provided downstream of the outdoor heat exchanger (23) along the flow of the refrigerant in the refrigerant circuit (11) in the cooling operation to adjust, for example, a pressure and a flow rate of the refrigerant flowing in the outdoor refrigerant circuit (11*b*). (In this embodiment, the outdoor expansion valve (38) is connected to the liquid side of the outdoor heat exchanger (23).)

The outdoor unit (20) includes an outdoor fan (28) acting as an air blower for sucking outdoor air into the unit, causing the outdoor heat exchanger (23) to exchange heat between the sucked air and the refrigerant, and then ejecting the air out of the outdoor unit (20). This outdoor fan (28) is capable of adjusting a volume of air to be supplied to the outdoor heat exchanger (23). The outdoor fan (28) may be a propeller fan driven by a motor (28*m*) such as a DC fan motor.

The liquid stop valve (26) and the gas stop valve (27) are provided to connecting ports of external devices and piping (specifically, the liquid interconnecting pipe (71) and the gas interconnecting pipe (72)). The liquid stop valve (26) is provided downstream of the outdoor expansion valve (38) and upstream of the liquid interconnecting pipe (71) along the flow of the refrigerant in the refrigerant circuit (11) in the cooling operation. The liquid stop valve (26) is capable of blocking the flowing refrigerant. The gas stop valve (27) is connected to the four-way switching valve (22).

Moreover, the outdoor unit (20) is provided with various kinds of sensors. Specifically, the outdoor unit (20) includes: an inlet pressure sensor (29) detecting an inlet pressure (i.e., a refrigerant pressure corresponding to an evaporating pressure Pe in the cooling operation) of the compressor (21); a discharge pressure sensor (30) detecting a discharge pressure (i.e., a refrigerant pressure corresponding to a condense pressure Pc in the heating operation) of the compressor (21); an inlet temperature sensor (31) detecting an inlet temperature of the compressor (21); and a discharge temperature sensor (32) detecting a discharge temperature of the compressor (21). An outdoor air inlet port of the outdoor unit (20) is provided with an outdoor temperature sensor (36) detecting a temperature (i.e., an outdoor temperature) of the outdoor air flowing into the unit. In this embodiment, thermistors are used as the inlet temperature sensor (31), the discharge temperature sensor (32), and the outdoor temperature sensor (36).

Figure 2:
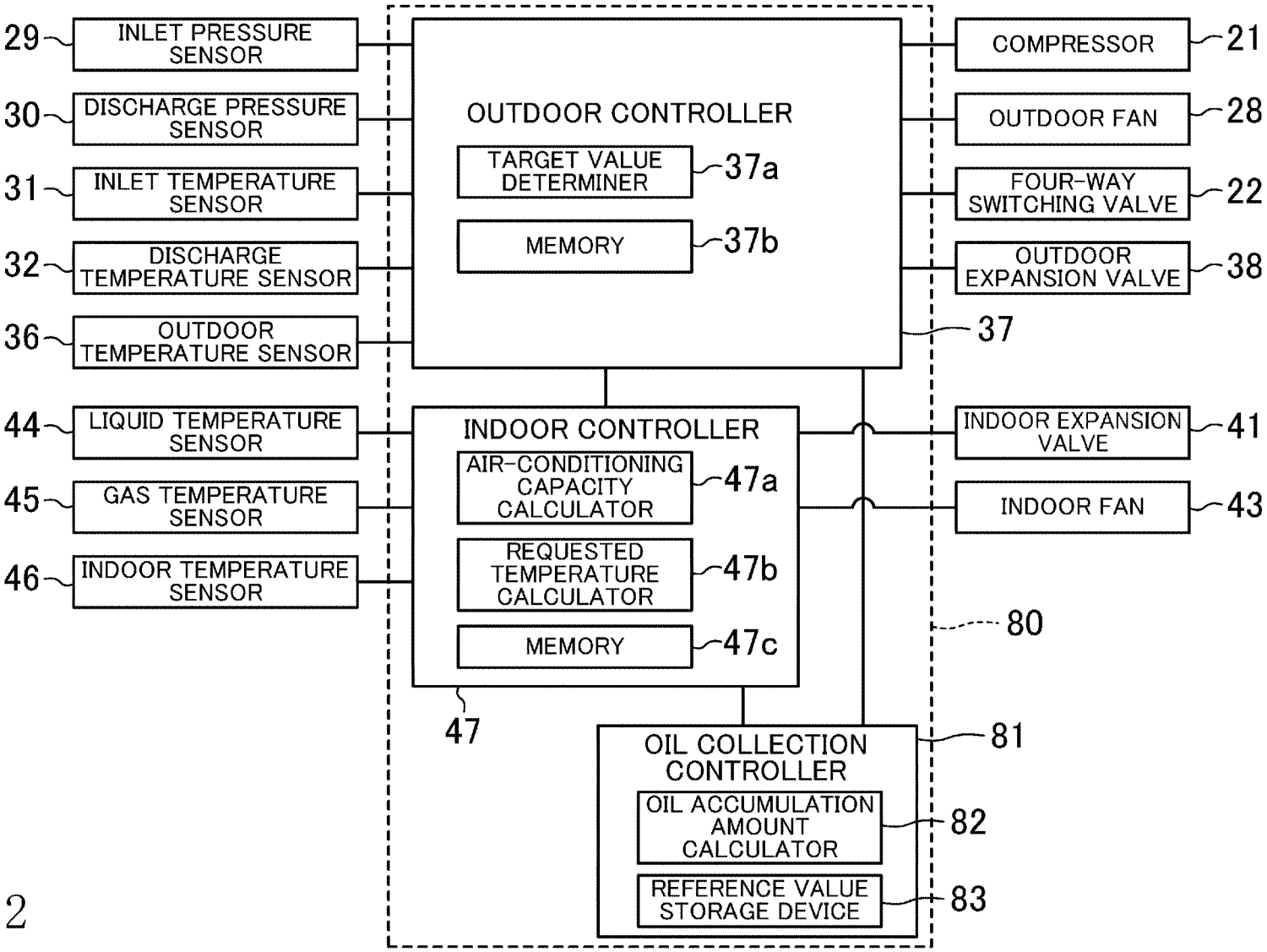
FIG. 2 is a block diagram showing how the air conditioning device is controlled.

Furthermore, the outdoor unit (20) includes an outdoor controller (37) controlling operations of the units included in the outdoor unit (20). As illustrated in FIG. 2, the outdoor controller (37) includes a target value determiner (37*a*) changing, at predetermined time intervals, a target evaporation temperature Tet or a target condensing temperature Tct for controlling the operational capacity of the compressor (21). The outdoor controller (37) allows the air conditioning device (10) to save energy during its operation. Then, the outdoor controller (37) includes a microcomputer controlling the outdoor unit (20), a memory (37*b*), and an inverter circuit controlling the motor (21*m*). The outdoor controller (37) may exchange, for example, a control signal with the indoor controller (47) of the indoor unit (40) via the transmission pipe (80*a*). In other words, the indoor controllers (47), the outdoor controller (37), and the transmission pipe (80*a*) connecting the indoor controllers (47) with the outdoor controller (37) constitute a controller (an operation controller) (80) controlling operation of the whole air conditioning device (10).

Energy-saving control in the cooling operation is provided as described below. First, the indoor controllers (47) of the corresponding indoor units (40) calculate requested evaporation temperatures Ter based on, for example, a temperature difference between an inlet temperature and a set temperature, and transmit the requested evaporation temperatures Ter to the outdoor controller (37). Next, the outdoor controller (37) of the outdoor unit (20) selects the lowest requested evaporation temperature from among the requested evaporation temperatures Ter transmitted from the indoor units (40), and determines the selected temperature to be a target evaporation temperature Tet as a target value for the control. Here, the determined target evaporation temperature Tet is a current value of the evaporation temperature (a current value of the refrigerant state value). Then, this target evaporation temperature determination process is executed at predetermined time intervals (for example, every three minutes) such that the air conditioning device (10) stably operates while saving energy. Note that in the heating operation, the outdoor controller (37) selects the highest requested condensing temperature from among the requested condensing temperatures calculated and transmitted by the indoor units (40), and determines the selected temperature to be a target condensing temperature Tct. Here, the determined target condensing temperature Tct is a current value of the condensing temperature (a current value of the refrigerant state value).

As FIG. 2 illustrates in a block diagram showing how the air conditioning device (10) is controlled, the controller (80) is connected to various sensors (29 to 32, 36, and 44 to 46) to receive the detecting signals of the sensors. The controller (80) is also connected to various devices and valves (21, 22, 28, 38, 41, and 43) to control the devices and the valves based on such signals as the detecting signals. Furthermore, the memories (37*b*, 47*c*) of the controller (80) store various kinds of data.

The controller (80) includes an air-conditioning capacity controller (37*a*, 47*a*, 47*b*) determining a target value of the evaporation temperature or the condensing temperature of the refrigerant circuit (11), depending on the air-conditioning load in a room, and based on the target value, controlling the operational capacity of the compressor (21) in the refrigerant circuit. The air-conditioning capacity controller (37*a*, 47*a*, 47*b*) includes: the target value determiner (37*a*); the air-conditioning capacity calculator (47*a*); and the requested temperature calculator (47*b*).

The controller (80) includes an oil collection controller (81). The oil collection controller (81) includes an oil accumulation amount calculator (82) and a reference value storage (83). The oil collection controller (81) calculates, at predetermined time intervals, an amount of refrigerating machine oil accumulated in the interconnecting pipe (71,72) during the operation, and integrates the amount calculated for each predetermined time interval. When a value of the integration exceeds a preset amount, the oil collection controller (81) performs oil collecting operation for collecting the refrigerating machine oil in the refrigerant circuit (11) into the compressor (21).

The oil accumulation amount calculator (82) compares (i) a current value of a target evaporation temperature or a target condensing temperature of the refrigerant circuit (11) with (ii) a set value of the evaporation temperature or the condensing temperature. When the gas branch pipes (72*b*) are determined to include a gas branch pipe (72*b*) which does not satisfy the lower limit flow rate, the oil accumulation amount calculator (82) determines that the refrigerating machine oil accumulates in the gas branch pipe (72*b*), and calculates an amount of the refrigerating machine oil accumulated in the gas branch pipe (72*b*). Here the set value is a reference value determined, for each of the indoor units (40), to correspond to the lower limit flow rate, of the gaseous refrigerant, necessary for the refrigerating machine oil to flow together with the refrigerant, and not to accumulate, in the gas branch pipes (72*b*). Then, the oil collection controller (81) obtains this accumulated amount for each predetermined time period, and integrates the obtained accumulated amounts. When the integrated value exceeds the set amount, the oil collection controller (81) performs oil collecting operation. Note that, in this embodiment, the oil accumulation amount calculator calculates the amount of oil accumulated for each predetermined time interval, and integrates the calculated amounts more frequently, than the determination of the evaporation temperature. Even while the operational capacity of the compressor (21) is being controlled with the target evaporation temperature determined to be a predetermined value, the operational capacity of the compressor could vary. Frequently calculating the accumulated oil amount as described above contributes to more accurate calculation of the accumulated oil amount. However, the oil accumulation amount calculator (82) may calculate the accumulated oil amount for each predetermined time interval as frequently as, or less frequently than, the determination of the evaporation temperature. The same or less frequency in the calculation saves the number of processing times, allowing for the use of a less expensive microcomputer for the outdoor controller and an indoor controller.

The reference value storage (83) stores, as a reference value for determining the flow rate of the gaseous refrigerant, an evaporation temperature or a condensing temperature representing a refrigerant state value indicating a state of the refrigerant corresponding to the preset lower limit flow rate in branch pipe determined for each of the gas branch pipes (72*b*). Moreover, when the air conditioning device (10) is in, for example, a trial operation, the outdoor unit (20) receives information on a model of each indoor unit (40) connected to the outdoor unit (20), and stores a capacity of the indoor units (40). At this point of time, the outdoor unit (20) has the model information on each of the indoor units (40), and information (a refrigerant state value indicating a lower limit flow rate in branch pipe) on each of the gas branch pipes (72*b*) connected to a corresponding one of the indoor units (40). Then, based on the stored information when calculating the amount of oil accumulated in branch pipe, the oil accumulation amount calculator (82) compares, for each of the gas branch pipes (72*b*), a current value of the refrigerant state value with the reference value, determines whether the flow rate of the gaseous refrigerant is lower than the lower limit flow rate in branch pipe (i.e., whether the oil accumulates), obtains the amount of oil accumulated in a gas branch pipe (72*b*) having a flow rate of the gaseous refrigerant lower than the lower limit flow rate in branch pipe, and calculates the integrated value.

Moreover, as illustrated in FIGS. 3 and 4, the reference value storage (83) has the reference value, of the lower limit flow rate for the gas branch pipes (72*b*), for three air volume levels to be set for each indoor unit (40). The oil accumulation amount calculator (82) compares, for each indoor unit (40), the reference value for the air volume levels with a current value of the target evaporation temperature or the target condensing temperature of the refrigerant in a gas branch pipe (72*b*), determines whether the gas branch pipes (72*b*) include a gas branch pipe (72*b*) in which a flow rate of the gaseous refrigerant is lower than the lower limit flow rate, and calculates the amount of the accumulated refrigerating machine oil.

As described above, the controller (80) controls to maintain, the evaporation temperature at the target value during the cooling operation. Furthermore, the oil accumulation amount calculator (82) determines whether the gas branch pipes (72*b*) includes a gas branch pipe (72*b*) in which a current value of the target evaporation temperature is higher than the set value (reference value), and calculates the accumulated amount of refrigerating machine oil. This is because when the current value of the target evaporation temperature is higher than the set value (the reference value) in the cooling operation, the flow rate of the refrigerant in the gas branch pipe (72*b*) is determined to be low. Moreover, the oil collection controller (81) performs the oil collecting operation, staying in the cooling cycle. Note that, in this control, the current value of the target evaporation temperature is compared with the set value (the reference value). Here, the target evaporation temperature is used because the actual evaporation temperature will reach the target value at any point in time. Depending on conditions, an actual evaporation temperature may be used instead of the target evaporation temperature.

Moreover, the controller (80) controls to maintain the condensing temperature at the target value during the heating operation. Then, the oil accumulation amount calculator (82) determines whether the gas branch pipes (72*b*) include a gas branch pipe (72*b*) in which a current value of the target condensing temperature is lower than the set value, and calculates the accumulated amount of refrigerating machine oil. This is because when the current value of the target condensing temperature is lower than the set value in the heating operation, the flow rate of the refrigerant in the gas branch pipe (72*b*) is determined to be low. Moreover, the oil collection controller (81) performs the oil collecting operation, with the heating operation switching to the cooling cycle. In this case, too, the target condensing temperature is compared with the set value. Here, because of a similar reason as seen in the cooling operation, an actual condensing temperature may be used instead of the target condensing temperature.

<Interconnecting Line>

When the air conditioning device (10) is installed in an installation site such as a building, the interconnecting pipe (71,72); namely refrigerant pipes, are installed at the installation site. The interconnecting pipe (71,72) for use vary in length and diameter, depending on installation conditions such as a combination of the outdoor unit (20) and the indoor units (40). Then, when an air conditioning device (10) is newly installed, for example, the air conditioning device (10) needs to be charged with an appropriate amount of refrigerant, depending on installation conditions such as lengths and diameters of the interconnecting pipe (71,72).

As can be seen, the indoor refrigerant circuit (11*a*), the outdoor refrigerant circuit (11*b*), and the interconnecting pipe (71,72) are connected to each other to constitute the refrigerant circuit (11) of the air conditioning device (10). The air conditioning device (10) in this embodiment causes the controller (80), including the indoor controller (47) and the outdoor controller (37), to control the four-way switching valve (22) and switch between the cooling operation and the heating operation to perform. Meanwhile, the air conditioning device (10) causes the controller (80) to control the devices in the outdoor unit (20) and the indoor units (40), so that the air conditioning device (10) also performs the oil collecting operation.

—Operation—

Described next is operation of the air conditioning device (10).

The air conditioning device (10) performs indoor temperature control with respect to each of the indoor units (40) in the cooling operation and the heating operation below. In the indoor temperature control, the indoor temperature Tr is brought closer to a set temperature Ts set by a user with an input device such as a remote control. When the indoor fan (43) is set to the auto air volume mode, the indoor temperature control involves adjusting a volume of air from each indoor fan (43) and an opening of each indoor expansion valve (41) to bring the indoor temperature Tr to the set temperature Ts. When the indoor fan (43) is set to the air volume holding mode, the indoor temperature control involves adjusting an opening of each indoor expansion valve (41) to bring the indoor temperature Tr to the set temperature Ts. Note that the statement "adjusting an opening of each indoor expansion valve (41)" is to control a degree of superheat at an outlet of each indoor heat exchanger (42) in the case of the cooling operation, and to control a degree of subcooling at the outlet of each indoor heat exchanger (42) in the case of the heating operation.

<Cooling Operation>

Described first is the cooling operation with reference to FIG. 1.

In the cooling operation, the four-way switching valve (22) is in a state illustrated in the solid pipes in FIG. 1: the compressor (21) has (i) the discharge side connected to the gas side of the outdoor heat exchanger (23), and (ii) the suction side connected to the gas side of the indoor heat exchangers (42) via the gas stop valve (27) and the gas interconnecting pipe (72). Here, the outdoor expansion valve (38) is fully open. The liquid stop valve (26) and the gas stop valve (27) are open. An opening of each indoor expansion valve (41) is controlled so that the degree of superheat SH, of the refrigerant, at the outlet (that is, the gas side of the indoor heat exchanger (42)) of the indoor heat exchanger (42) is a target degree of superheat SHt. Note that the target degree of superheat SHt is set at an optimum value to bring the indoor temperature Tr to the set temperature Ts within a predetermined range of a degree of superheat. In this embodiment, the degree of superheat SH, of the refrigerant, at the outlet of the each indoor heat exchanger (42) is detected when a refrigerant temperature (equivalent to the evaporation temperature Te) detected by the liquid temperature sensor (44) is subtracted from a refrigerant temperature detected by the gas temperature sensor (45). Note that, a technique to detect the degree of superheat SH, of the refrigerant, at the outlet of each indoor heat exchanger (42) shall not be limited to the above technique. The degree of superheat SH may be detected as follows: the suction pressure of the compressor (21) detected by the suction pressure sensor (29) is converted into a saturation temperature of this refrigerant corresponding to the evaporation temperature Te, and the saturation temperature is subtracted from the refrigerant temperature detected by the gas temperature sensor (45).

When the compressor (21), the outdoor fan (28), and the indoor fans (43) operate in this state of the refrigerant circuit (11), a low-pressure gaseous refrigerant is sucked into, and compressed by, the compressor (21) to become a high-pressure gaseous refrigerant. After that, the high-pressure gaseous refrigerant is sent through the four-way switching valve (22) to the outdoor heat exchanger (23), exchanges heat with outdoor air to be supplied by the outdoor fan (28), and condenses to become a high-pressure liquid refrigerant. Then, this high-pressure liquid refrigerant is sent through the liquid stop valve (26) and the liquid interconnecting pipe (71) to each indoor unit (40).

The high-pressure liquid refrigerant sent to the indoor unit (40) is decompressed by the indoor expansion valve (41) close to the inlet pressure of the compressor (21) to be a refrigerant in a two-phase gas-liquid state, and sent to the indoor heat exchanger (42). The refrigerant then exchanges heat with indoor air in the indoor heat exchanger (42), and evaporates to become a low-pressure gaseous refrigerant.

This low-pressure gaseous refrigerant is sent through each gas interconnecting pipe (72) to the outdoor unit (20), and flows through the gas stop valve (27) and the four-way switching valve (22) into the accumulator (24). The low-pressure gaseous refrigerant flowing into the accumulator (24) is sucked into the compressor (21) again. Hence, the air conditioning device (10) performs the cooling operation in which the outdoor heat exchanger (23) functions as a condenser of the refrigerant compressed by the compressor (21) and the indoor heat exchangers (42) functions as evaporators of the refrigerant condensed by the outdoor heat exchanger (23) and then sent through the liquid interconnecting pipe (71) and the indoor expansion valve (41). Note that, in the air conditioning device (10), the gas side of the indoor heat exchangers (42) does not have a mechanism to adjust pressure of the refrigerant. Hence, the evaporating pressure Pe is common to all the indoor heat exchangers (42). In other words, when the gas side of the indoor heat exchangers (42) is provided with the mechanism to adjust the refrigerant, the evaporating pressure to the indoor heat exchangers (42) may be changed to any given level.

In this cooling operation, the air conditioning device (10) of this embodiment may perform energy-saving control. In the energy-saving control, the air-conditioning capacity calculator (47*a*) of the indoor controller (47) in each indoor unit (40) calculates the air-conditioning capacity of the indoor unit (40) at that time. Moreover, the air-conditioning capacity calculator (47*a*) calculates required capacity based on a set temperature. The controller (80) adjusts operational capacity of the compressor (21), an opening of each indoor expansion valve (41), and a volume of air from each indoor fan (43). As described above, the outdoor controller (37) then selects the lowest requested evaporation temperature from among the requested evaporation temperatures Ter transmitted from the indoor units (40), and determines the selected temperature to be a target evaporation temperature Tet as a target value for the control. This target evaporation temperature determination process is executed at predetermined time intervals (for example, every three minutes) such that the air conditioning device (10) operates not to exceed required capacity while maintaining the evaporation temperature high.

—Heating Operation—

Described next is the heating operation with reference to FIG. 1.

In the heating operation, the four-way switching valve (22) is in a state illustrated in the broken pipes in FIG. 1: the compressor (21) has (i) the discharge side connected to the gas side of the indoor heat exchangers (42) via the gas stop valve (27) and the gas interconnecting pipe (72), and (ii) the suction side connected to the gas side of the outdoor heat exchanger (23). An opening of the outdoor expansion valve (38) may be adjusted so that the refrigerant flowing into the outdoor heat exchanger (23) is decompressed to have a pressure (that is, the evaporating pressure Pe) at which the refrigerant may evaporate in the outdoor heat exchanger (23). Furthermore, the liquid stop valve (26) and the gas stop valve (27) are open. An opening of each indoor expansion valve (41) is controlled so that the degree of subcooling SC, of the refrigerant, at the outlet of the indoor heat exchanger (42) is a target degree of subcooling SCt. Note that the target degree of subcooling SCt is set at an optimum value to bring the indoor temperature Tr to the set temperature Ts within a range of a degree of subcooling specified depending on an operating state of the time. In this embodiment, the degree of subcooling SC, of the refrigerant, at the outlet of the each indoor heat exchanger (42) is detected when a discharge pressure Pd, of the compressor (21), detected by the discharge pressure sensor (30) is converted into a saturation temperature of the refrigerant corresponding to the condensing temperature Tc, and a refrigerant temperature, detected by the liquid temperature sensor (44), is subtracted from this saturation temperature.

When the compressor (21), the outdoor fan (28), and the indoor fans (43) operate in this state of the refrigerant circuit (11), a low-pressure gaseous refrigerant is sucked into, and compressed by, the compressor (21) to become a high-pressure gaseous refrigerant. The high-pressure gaseous refrigerant is then sent through the four-way switching valve (22), the gas stop valve (27), and the gas interconnecting pipe (72) to the indoor units (40).

The high-pressure gaseous refrigerant sent to each indoor unit (40) then exchanges heat with indoor air in the indoor heat exchanger (42), and condenses to be a high-pressure liquid refrigerant. After that, when passing through the indoor expansion valve (41), the high-pressure liquid refrigerant is decompressed, depending on an opening of the indoor expansion valve (41).

The refrigerant passing through this indoor expansion valve (41) is sent through each liquid interconnecting pipe (71) to the outdoor unit (20), further decompressed through the liquid stop valve (26) and the outdoor expansion valve (38), and flows into the outdoor heat exchanger (23). After that, the refrigerant having low pressure in a two-phase gas-liquid state and flowing into the outdoor heat exchanger (23) exchanges heat with outdoor air to be supplied by the outdoor fan (28), and evaporates to become a low-pressure gaseous refrigerant. The low-pressure gaseous refrigerant flows through the four-way switching valve (22) into the accumulator (24). The low-pressure gaseous refrigerant flowing into the accumulator (24) is sucked into the compressor (21) again. Note that, in the air conditioning device (10), the gas side of the indoor heat exchangers (42) does not have a mechanism to adjust pressure of the refrigerant. Hence, the condense pressure Pc is common to all the indoor heat exchangers (42).

In this heating operation, the air conditioning device (10) of this embodiment may perform energy-saving control. In the energy-saving control, the air-conditioning capacity calculator (47*a*) of the indoor controller (47) in each indoor unit (40) calculates the air-conditioning capacity of the indoor unit (40) at that time. Moreover, the air-conditioning capacity calculator (47*a*) calculates required capacity based on a set temperature. The controller (80) adjusts operational capacity of the compressor (21), an opening of each indoor expansion valve (41), and a volume of air from each indoor fan (43), such that, as controlled in a similar manner to the cooling operation, the air conditioning device (10) operates not to exceed required capacity while maintaining the condensing temperature low.

<Oil Collecting Operation>

Oil collecting operation in the cooling operation is performed as follows.

First, when the compressor (21) is activated to operate, whether a start condition for the oil collecting operation is satisfied is constantly subject to determination. Specifically, as described above, the oil collection controller (81) calculates, at predetermined time intervals, an amount of refrigerating machine oil accumulated in the gas interconnecting pipe (72), and integrates the amounts calculated for the predetermined time intervals. When the integrated value of the accumulated amounts exceeds a set amount, the oil collection controller (81) determines that the start condition for the oil collecting operation is satisfied, and performs the oil collecting operation for collecting the refrigerating machine oil in the refrigerant circuit (11) into the compressor (21). Here, this embodiment involves estimating, based on an evaporation temperature, not only the flow rate of the gaseous refrigerant in the gas main pipe (72*a*), but also the flow rate of the gaseous refrigerant in each of the gas branch pipes (72*b*). When the flow rate in each gas branch pipe (72*b*) does not satisfy the lower limit of the flow rate required for oil collection, the above integrated value is obtained from the amount of machine oil accumulated in the gas main pipe (72*a*) and the gas branch pipes (72*b*).

The reason why the above calculation result is the start condition for the oil collection is that when the amount of the refrigerating machine oil accumulated in the gas interconnecting pipe (72) exceeds a set amount, the amount of oil loss in the compressor (21) exceeds the predetermined value, and the amount of refrigerating machine oil stored in the compressor (21) is determined to be lower than a predetermined level. Note that when two or more compressors (21) are present, the oil collecting operation is performed if the start condition is satisfied in any one of the compressors (21). Moreover, the start condition for the oil collecting operation is also to be satisfied after a time set on a timer has elapsed. For example, the above start condition is to be satisfied when the compressor (21) continues operating (i) for two hours and longer without the oil collecting operation after activation of power, and (ii) for eight hours and longer since the previous oil collection.

When the above start condition is satisfied, the number of thermo-on indoor units (40) and thermo-off indoor units (40) are checked. Then, the air conditioning device (10) continues operating for a predetermined time period so that the flow rates of the refrigerant in the gas branch pipes (72*b*) and the gas main pipe (72*a*) increase to predetermined flow rates. The increased flow rates cause the gaseous refrigerant to push the oil such that the oil is collected into the compressor (21). Furthermore, in certain instances, the air conditioning device (10) performs humidity operation control which keeps the refrigerant from completely evaporating in the indoor heat exchangers (42) acting as evaporators so that the refrigerating machine oil is collected into the compressor (21) by the liquid refrigerant. Then, when the oil collecting operation ends, the air conditioning device (10) goes back to the normal operation.

Specifically described here with reference to FIG. 3 is how to calculate the amount of accumulated oil during the oil collection control in the cooling operation. FIG. 3 is a table showing set values of evaporation temperatures Te as reference values corresponding to a lower limit flow rate in oil collection for four indoor units (40) each having a different capacity. The values in this table are stored in the reference value storage (83).

First, for thermo-on indoor units (40), evaporation temperatures Te corresponding to a lower limit flow rate in oil collection are obtained from the table in FIG. 3. Then, the smallest of the evaporation temperatures is designated as the reference value of the lower limit flow rate. For example, when the thermo-on indoor units include: an indoor unit having a capacity of Q1, an indoor unit having a capacity of Q2, an indoor unit having a capacity of Q3, and an indoor unit having a capacity of Q4 (Q1<Q2<Q3<Q4) where a fan tap for the indoor unit having the capacity of Q1 is L, a fan tap for the indoor unit having the capacity of Q2 is M, a fan tap for the indoor unit having the capacity of Q3 is H, and a fan tap for the indoor unit having the capacity of Q4 is M, the lowest evaporation temperature Te representing a reference value of the oil collection lower limit flow rate is 11° C. Note that information on the fan tap for each indoor unit is to be received from the indoor unit for every time the accumulated oil amount is calculated.

Next, for an indoor unit (40) not satisfying the lower limit flow rate of the oil collection, the flow rate of oil (the amount of accumulated oil) flowing through the gas branch pipe (72*b*) is calculated. The amount of accumulated oil is obtained by the product of a value A and one of, for example, a volume of circulating refrigerant, a rate of oil loss in the compressor, and a refrigerant solubility per unit time ΔT. Here, A indicates a rate of thermo-on indoor units which do not satisfy the lower limit flow rate for oil collection with respect to the total capacity of all the thermo-on indoor units. The value A is obtained as follows:

A=Total capacity of thermo-on indoor units not having a lower limit flow rate for oil collection/
Total capacity of all thermo-on indoor units.

When the gas main pipe (72*a*) is short of flow rate, the relationship A=1 holds because all the indoor units are short of flow rate.

Moreover, when the target evaporation temperature Tet is 14.5° C. where the fan taps of the thermo-on indoor units (40) are set at Q1 (L), Q2 (M), Q3 (H), and Q4 (H), the rate A of thermo-on indoor units having the target value of the evaporation temperature Tet of 14.5° C. or below with respect to the thermo-on indoor units is obtained as follows:

$$A=(Q1+Q2)/(Q1+Q2+Q3+Q4)$$

Furthermore, when an integration is to be executed for every 20 seconds, the relationship ΔT=20 holds. The amount of accumulated oil is obtained from these values, and, based on the accumulated amount of oil, the integrated value is calculated. As can be seen, in this embodiment, the amount of accumulated oil is obtained through a comparison between the reference value (a set value) and a current value of the target evaporation temperature for each of the gas branch pipes (72*b*) (in view of a flow rate of the gaseous refrigerant), then, based on the amount of accumulated oil, the integrated value is obtained.

Here, when the flow rate of the gaseous refrigerant in the gas main pipe (72*a*) is determined to be lower than the lower limit flow rate in main pipe, the amount of the refrigerating machine oil accumulated in the gas main pipe (72*a*) is calculated as the amount of oil accumulated in main pipe. Alternatively, even though the flow rate of the gaseous refrigerant in the gas main pipe (72*a*) is higher than the preset lower limit flow rate in main pipe, when the gas branch pipes (72*b*) include a gas branch pipe (72*b*) having a flow rate of the gaseous refrigerant higher than a preset lower limit flow rate in branch pipe and a gas branch pipe (72*b*) having a flow rate of the gaseous refrigerant lower than the preset lower limit flow rate in branch pipe, the amount of the refrigerating machine oil accumulated in the gas branch pipe (72*b*) having the flow rate lower than the preset lower limit flow rate in branch pipe is calculated as the accumulated amount in branch pipe. Hence, the oil accumulation amount calculator (82) calculates the amounts of oil accumulated in the gas main pipe (72*a*) and the gas branch pipes (72*b*), and, based on these amounts. calculates the above integrated value. Then, when the calculated integrated value exceeds the set amount, the oil collecting operation is performed so that the refrigerating machine oil in the refrigerant circuit (11) is collected in the compressor (21).

Note that when two compressors are present, the accumulated amount of oil may be calculated for each of the compressors. Based on the accumulated amounts, the total accumulated amount may be obtained for the oil collecting operation.

In addition, after the end of the oil collecting operation, the oil accumulation amount calculator (82) resets the amount of accumulated oil, and the air conditioning device (10) performs the normal operation. Meanwhile, the oil accumulation amount calculator (82) newly calculates and integrates amounts of the oil accumulated in the gas interconnecting pipe (72) to prepare for the next oil collecting operation.

Meanwhile, in the heating operation, the amount of oil accumulated in the gas interconnecting pipe (72) is calculated based on the table in FIG. 4. The calculated values are integrated for every predetermined time period ΔT, and an integrated value of the accumulated oil amount is obtained. The heating operation is different from the cooling operation in that, when the target condensing temperature Tct is lower than a reference value in the table of FIG. 4, the refrigerating machine oil is determined not to be collected into the compressor (21) because the flow rate of the gaseous refrigerant is low. Otherwise, the integrated value is obtained in a similar manner as seen in the cooling operation.

Moreover, in the heating operation, the refrigerant flows through the gas interconnecting pipe (72) toward the indoor heat exchangers (42). Since this refrigeration cycle makes it difficult for the oil to be collected into the compressor (21), the oil collecting operation is performed with the refrigeration cycle switched to the cooling cycle so that the gaseous refrigerant is sucked into the compressor (21). Such a feature allows for easy collection of the oil remaining in the gas interconnecting pipe (72) even in the heating operation.

—Advantages of Embodiment—

In energy-saving operation, this embodiment makes it possible to control the oil collecting operation, in view of a flow rate of the gaseous refrigerant in the gas branch pipes (72*b*), reducing the risk of a lubrication-related malfunction caused by oil shortage in the compressor (21).

Furthermore, the embodiment involves comparing (i) a current value of a target evaporation temperature or a target condensing temperature of a refrigerant in a gas branch pipe (72*b*) with (ii) a reference value of the lower limit flow rate of the gaseous refrigerant, depending on multiple air volume levels to be set for an indoor unit (40) to which the gas branch pipe (72*b*) is connected, and determining whether the refrigerating machine oil is accumulated in the gas branch pipe (72*b*). Based on the result of the determination, the embodiment involves calculating the amount of the refrigerating machine oil accumulated in the gas branch pipe (72*b*), and, when the accumulated amount exceeds a set amount, performing the oil collecting operation. Such features make it possible to enhance control precision of the oil collecting operation in view of the flow rate of the gaseous refrigerant in the gas branch pipes (72*b*), reducing the risk of lubrication-related malfunction in the compressor (21). The use of a reference value for the multiple air volume levels makes the control accurate. This is because if the indoor units (40) are the same in capacity, an evaporation temperature and a condensing temperature, determined by the lower limit flow rate in oil collection, vary in accordance with an air volume level. When different reference values are set for different air volume levels, the necessity for the oil collection is determined more precisely than when one average value is set as a reference value.

Moreover, the above embodiment involves determining whether the gas branch pipes (72*b*) include a gas branch pipe (72*b*) in which a current value of the target evaporation temperature is higher than the set value, and calculating the accumulated amount of the refrigerating machine oil. When the accumulated amount exceeds the set amount, the embodiment involves performing the oil collecting operation, staying in the cooling cycle. Such features make it possible to collect the refrigerating machine oil accumulated in the gas branch pipe (71*b*) into the compressor (21).

Moreover, in the heating operation, the above embodiment involves determining whether the gas branch pipes (72*b*) include a gas branch pipe (72*b*) in which a current value of the target condensing temperature is lower than the set value, and calculating the accumulated amount of the refrigerating machine oil. When the accumulated amount exceeds the set amount, the embodiment involves performing the oil collecting operation, with the heating operation switching to the cooling cycle. Such features make it possible to collect the refrigerating machine oil accumulated in the gas branch pipe (71*b*) into the compressor (21).

«Other Embodiments»

The above embodiment may also have the configurations below.

For example, in the heating operation, the above embodiment involves determining whether the gas branch pipes (72*b*) include a gas branch pipe (72*b*) in which a current value of the target condensing temperature is lower than the set value, calculating the accumulated amount of the refrigerating machine oil, and, when the accumulated amount exceeds the set amount, performing the oil collecting operation, with the heating operation switching to the cooling cycle. However, the oil collecting operation is performed, staying in the heating cycle. When the oil collecting operation is performed, staying in the heating cycle, the flow rate of the refrigerant is raised so that the refrigerating machine oil in the gas branch pipes (72*b*) flows from the indoor units (40) through the liquid main pipe (71*a*), and is collected in the compressor (21) from an opposite direction in the cooling cycle.

In addition, in the oil collecting operation in the cooling operation, a thereto-off indoor unit (40) during oil collection turns to a thermo-on state by a forced thermo-on command from the outdoor unit (20), and performs the same operation as a thermo-on indoor unit (40) does. However, an indoor unit (40) in an antifreeze mode and thus in the thermo-off state does not accept the forced thermo-on command from the outdoor unit (20). Such an indoor unit (40) may be left in the thermo-off state (EV=0 pls). When all the indoor units (40) are controlled to perform the oil collecting operation while being switched to the antifreeze mode, the oil collecting operation is to be performed with outdoor unit (20) shut up. Thus, the oil collection may be suspended, and then be resumed after a restart stand-by (a cancellation of the antifreeze mode).

Moreover, an integration of antifreeze counts should not be performed during the oil collection and the control of the oil collecting operation may be prioritized, so that the indoor units (40) are kept from being switched to the antifreeze mode during the oil collection.

Furthermore, in the above embodiment, the present invention is applied to an air conditioning device including one outdoor unit (20) and four indoor units (40): however, the number of outdoor units (20) and indoor units (40) may be changed appropriately.

In addition, the reference values of the evaporation temperature in FIG. 3 and the condensing temperature in FIG. 4 are mere examples. The reference values may be appropriately changed depending on the structure of an air conditioning device. Moreover, FIGS. 3 and 4 show an example that three kinds of fan taps are set; however, the number of the kinds of fan taps may be changed to, for example, 10.

Note that the foregoing description of the embodiments is a merely beneficial example in nature, and is not intended to limit the scope, application, or uses of the present disclosure.

INDUSTRIAL APPLICABILITY

As can be seen, the present invention is useful for control of oil collecting operation for an air conditioning device to which an outdoor unit and indoor units are connected, the air conditioning device determining a target value of an evaporation temperature or a condensing temperature of a refrigerant circuit, depending on air-conditioning load in a room, and based on the target values, controlling operational capacity of a compressor.

DESCRIPTION OF REFERENCE CHARACTERS

10 Air Conditioning Device
11 Refrigerant Circuit
20 Outdoor Unit
37*a* Target Value Determiner (Air-Conditioning Capacity Controller)
40 Indoor Unit
47*a* Air-Conditioning Capacity Calculator (Air-Conditioning Capacity Controller)
47*b* Requested Temperature Calculator (Air-Conditioning Capacity Controller)
71 Liquid Interconnecting Line
71*a* Liquid Main Line
71*b* Liquid Branch Line
72 Gas Interconnecting Line
72*a* Gas Main Line
72 Gas Branch Line
80 Operation Controller (Controller)
81 Oil Collection Controller
82 Oil Accumulation Amount Calculator
83 Reference Value Storage

The invention claimed is:

1. An air conditioning device which includes:

a refrigerant circuit including an outdoor unit, a plurality of indoor units, an interconnecting pipe structure connecting the outdoor unit with the plurality of indoor units; and an operation controller controlling an operation of the refrigerant circuit, the interconnecting pipe structure including:

a liquid main pipe connected to the outdoor unit, and a plurality of liquid branch pipes each branching off from the liquid main pipe and each connected to a corresponding one of the plurality of indoor units; and a gas main pipe connected to the outdoor unit, and a plurality of gas branch pipes each branching off from the gas main pipe and each connected to a corresponding one of the indoor units, and the operation controller including an air-conditioning capacity controller, the air-conditioning capacity controller configured to determine a target value of an evaporation temperature or a condensing temperature of the refrigerant circuit, depending on an air-conditioning load in a room, and, based on the target value, control an operational capacity of the compressor in the refrigerant circuit, wherein the operation controller includes an oil collection controller, the oil collection controller configured to calculate an amount of refrigerating machine oil accumulated in the interconnecting pipe structure during the operation of the refrigerant circuit, and when the calculated amount exceeds a preset amount, perform an oil collecting operation for collecting the refrigerating machine oil in the refrigerant circuit into the compressor, and wherein the oil collection controller includes an oil accumulation amount calculator, the oil accumulation amount calculator configured to:

compare (i) a current value of the target evaporation temperature or the target condensing temperature of the refrigerant circuit with (ii) a set value of the evaporation temperature or the condensing temperature;

determine, when the gas branch pipes include a gas branch pipe which does not satisfy a lower limit flow rate such that the refrigerating machine oil accumulates in the gas branch pipe; and calculate an amount of the refrigerating machine oil accumulated in the gas branch pipe, the set value of the evaporation temperature or condensing temperature being a reference value determined, for each of the indoor units, to correspond to the lower limit flow rate of a gaseous refrigerant necessary for the refrigerating machine oil to flow together with the refrigerant and to not accumulate in the plurality of gas branch pipes.

2. The air conditioning device of claim 1, wherein the oil collection controller includes a reference value storage having a reference value of the evaporation temperature or the condensing temperature determined for one or more air volume levels to he set for each indoor unit, and the oil accumulation amount calculator is configured to compare, for each indoor unit, the reference value of the evaporation temperature or the condensing temperature for the one or more air volume levels with a current value of the target evaporation temperature or the target condensing temperature of the refrigerant in the plurality of gas branch pipes, determines whether the plurality of gas branch pipes include a gas branch pipe in which a flow rate of the gaseous refrigerant is lower than the lower limit flow rate, and calculates the amount of the accumulated refrigerating machine oil.

3. The air conditioning device of claim 1, wherein in a cooling operation, the oil accumulation amount calculator is configured to determine whether the plurality of gas branch pipes includes a gas branch pipe in which the current value of the evaporation temperature is higher than the set value of evaporation temperature, and calculate the accumulated amount of refrigerating machine oil, and the oil collection controller performs the oil collecting operation, staying in a cooling cycle.

4. The air conditioning device of claim 1, wherein in a heating operation, the oil accumulation amount calculator is configured to determine whether the plurality of gas branch pipes includes a gas branch pipe in which the current value of the condensing temperature is lower than the set value of the condensing temperature, and calculates the accumulated amount of refrigerating machine oil, and the oil collection controller performs the oil collecting operation, with the heating operation switching to a cooling cycle.

5. The air conditioning device of claim 1, wherein in a heating operation, the oil accumulation amount calculator is configured to determine whether the plurality of gas branch pipes includes a gas branch pipe in which the current value of the condensing temperature is lower than the set value of condensing temperature, and calculates the accumulated amount of refrigerating machine oil, and the oil collection controller performs the oil collecting operation, staying in a heating cycle.

6. The air conditioning device of claim 2, wherein in a cooling operation, the oil accumulation amount calculator is configured to determine whether the plurality of gas branch pipes includes a gas branch pipe in which the current value of the evaporation temperature is higher than the set value of evaporation temperature, and calculate the accumulated amount of refrigerating machine oil, and the oil collection controller performs the oil collecting operation, staying in a cooling cycle.

7. The air conditioning device of claim 2, wherein in a heating operation, the oil accumulation amount calculator is configured to determine whether the plurality of gas branch pipes includes a gas branch pipe in which the current value of the condensing temperature is lower than the set value of condensing temperature, and calculates the accumulated amount of refrigerating machine oil, and the oil collection controller performs the oil collecting operation, with the heating operation switching to a cooling cycle.

8. The air conditioning device of claim 2, wherein in a heating operation, the oil accumulation amount calculator is configured to determine whether the plurality of gas branch pipes includes a gas branch pipe in which the current value of the condensing temperature is lower than the set value of condensing temperature, and calculates the accumulated amount of refrigerating machine oil, and the oil collection controller performs the oil collecting operation, staying in a heating cycle.

* * * * *